United States Patent [19]

Trout

[11] Patent Number: 4,707,429

[45] Date of Patent: Nov. 17, 1987

[54] METALLIC SOAP AS ADJUVANT FOR ELECTROSTATIC LIQUID DEVELOPER

[75] Inventor: Torence J. Trout, Wilmington, Del.

[73] Assignee: E. I. Du Pont de Nemours and Company, Wilmington, Del.

[21] Appl. No.: 857,326

[22] Filed: Apr. 30, 1986

[51] Int. Cl.[4] ..... G03G 9/12

[52] U.S. Cl. ..... 430/115

[58] Field of Search ..... 430/115

[56] References Cited

U.S. PATENT DOCUMENTS

| | | | |
|---|---|---|---|
| 3,417,019 | 12/1968 | Beyer | 430/115 |
| 3,529,581 | 7/1966 | Matkan | 430/115 |
| 3,542,682 | 11/1970 | Mutaffis | 430/115 |
| 4,268,597 | 5/1981 | Klavan et al. | 430/102 |

FOREIGN PATENT DOCUMENTS

| | | | |
|---|---|---|---|
| 2428809 | 9/1975 | Fed. Rep. of Germany | 430/115 |
| 51-107833 | 9/1976 | Japan | 430/115 |
| 53-57039 | 5/1978 | Japan | 430/115 |
| 53-79541 | 7/1978 | Japan | 430/115 |
| 660012 | 12/1974 | U.S.S.R. | 430/115 |

*Primary Examiner*—Roland E. Martin

[57] ABSTRACT

Electrostatic liquid developer consisting essentially of (A) nonpolar liquid having Kauri-butanol value less than 30, present in major amount, (B) thermoplastic resin particles having a metallic soap as defined dispersed therein and average particle size by area being less than 10 μm, and (C) nonpolar liquid soluble ionic or zwitterionic charge director compound. Optionally a colorant and charge adjuvant are present. The electrostatic liquid developer is useful in copying, making proofs including digital color proofs, lithographic printing plates, and resists.

24 Claims, No Drawings

METALLIC SOAP AS ADJUVANT FOR ELECTROSTATIC LIQUID DEVELOPER

DESCRIPTION

1. Technical Field

This invention relates to an electrostatic liquid developer having improved properties. More particularly this invention relates to an electrostatic liquid developer containing resin particles having dispersed therein a metallic soap.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, etc. to the liquid toner comprising the thermoplastic resin, dispersant nonpolar liquid and preferably a colorant. Such liquid developers provide images of good resolution, but it has been found that charging and image quality are particularly pigment dependent. Some formulations, suffer from poor image quality manifested by low resolution, poor solid area coverage, and/or image squash. Some toners, particularly those having a plurality of fibers integrally extending therefrom, are highly flocculated and settle rapidly in the dispersion. In order to overcome such problems much research effort has been expended to develop new type charge directors and/or charging adjuvant for electrostatic liquid toners.

It has been found that the above disadvantages can be overcome and improved developers prepared containing a dispersant nonpolar liquid, ionic or zwitterionic charge director compound, a thermoplastic resin, and preferably a colorant. The improved electrostatic liquid developer when used to develop an electrostatic image results in improved image quality, reduced squash, improved solid area coverage independent of the pigment and charge director present.

DISCLOSURE OF THE INVENTION

In accordance with this invention there is provided an improved electrostatic liquid developer consisting essentially of (A) a nonpolar liquid having a Kauri-butanol value of less than 30, present in a major amount.

(B) thermoplastic resin particles having dispersed therein a metallic soap, the resin particles having an average by areas particle size of less than 10 μm, and (C) a nonpolar liquid soluble ionic or zwitterionic charge director compound.

In accordance with an embodiment of this invention there is provided a process for preparing electrostatic liquid developer for electrostatic imaging comprising (A) dispersing at an elevated temperature in a vessel a thermoplastic resin, a metallic soap, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (B) cooling the dispersion, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid;

(C) separating the dispersion of toner particles having an average by area particle size of less than 10 μm from the particulate media, and (D) adding to the dispersion a nonpolar liquid soluble ionic or zwitterionic charge director compound.

Throughout the specification the below-listed terms have the following meanings:

In the claims appended hereto "consisting essentially of" means the composition of the electrostatic liquid developer does not exclude unspecified components which do not prevent the advantages of the developer from being realized. For example, in addition to the primary components, there can be present additional components, such as a colorant, fine particle size oxides, adjuvant, e.g., polyhydroxy compound, aminoalcohol, polybutylene succinimide, aromatic hydrocarbon, etc.

Polyvalent with respect to the metal salts means a valence of two or more.

Aminoalcohol means that there is both an amino functionality and hydroxyl functionality in one compound.

Squash means the blurred edges of the image.

Beading means that there are large pools of toner in the solid areas of the image and breakage of lines in fine features.

Flow means that large droplets show in the solid areas of the image and there is smearing of fine features.

Conductivity is the conductivity of the developer measured in picomhos (pmho)/cm at 5 hertz and 5 volts and can be referred to as BULK.

Conductivity of the solution means the conductivity of the supernatant remaining after centrifugation and can be referred to as SOLN.

Conductivity attributed to the particles is the difference between the bulk conductivity and the conductivity of the solution and can be referred to as PART.

The dispersant nonpolar liquids (A) are, preferably, branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ®12 | 69 | 204 |
| Norpar ®13 | 93 | 210 |
| Norpar ®15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin. including components dispersed therein, and any pigment component present.

Useful thermoplastic resins or polymers include: ethylene vinyl acetate (EVA) copolymers (Elvax ® resins, E. I. du Pont de Nemours and Company, Wilmington, DE), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, DE, etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

The thermoplastic resins described above have dispersed therein a metallic soap wherein the polyvalent metals include: barium, calcium, magnesium, strontium, zinc, cadmium, aluminum, gallium, lead, chromium, manganese, iron, nickel, and cobalt and the acid portion is provided by a carboxylic acid of at least 6 carbon atoms, e.g., caproic acid, octoic (caprylic) acid, capric acid, lauric acid, myristic acid, palmitic acid, stearic acid, oleic acid, linolic acid, erucic acid, tallitic acid, resinic acid, naphthenic acid, etc. Examples of metallic soaps include: aluminum tristearate, aluminum distearate, barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinsates; etc. The metallic soap is present in 0.01 to 60 percent by weight, preferably 0.5 to 35 percent by weight based on the total weight of the developer solids. The method whereby the metallic soap is dispersed in the thermoplastic resin is described below.

In addition, the resins have the following preferred characteristics:

1. Be able to disperse the metallic soap, colorant, e.g., pigment,
2. Be insoluble in the dispersant liquid at temperatures below 40° C., so that the resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous.

Suitable nonpolar liquid soluble ionic or zwitterionic charge director compounds (C), which are generally used in an amount of 1 to 1000 mg/g, preferably 1 to 250 mg/g developer solids, include: positive charge directors, e.g., sodium dioctylsulfosuccinate (manufactured by American Cyanamid Co.), zirconium octoate and metallic soaps such as copper oleate, etc.; negative charge directors, e.g., lecithin, Basic Calcium Petronate®, Basic Barium Petronate® oil-soluble petroleum sulfonate, manufactured by Sonneborn Division of Witco Chemical Corp., New York, NY, alkyl succinimide (manufactured by Chevron Chemical Company of California), etc.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Stirling NS N 774 (Pigment Black 7, C.I. No. 77266).

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant which can be taken from the group of polyhydroxy compound which contains at least 2 hydroxy groups, aminoalcohol, polybutylene succinimide, and aromatic hydrocarbon having a Kauributanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc.

aminoalcohol compounds: triisopropanolamine, triethanolamine, ethanolamine, 3-amino-1-propanol, o-aminophenol, 5-amino-1-pentanol, tetra(2-hydroxyethyl) ethylenediamine, etc.

polybutylene/succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

aromatic hydrocarbon: benzene, toluene, naphthalene, substituted benzene and naphthalene compounds, e.g., trimethylbenzene, xylene, dimethyl-ethylbenzene, ethylmethylbenzene, propylbenzene, Aromatic 100 which is a mixture of $C_9$ and $C_{10}$ alkyl-substituted benzenes manufactured by Exxon Corp., etc.

The particles in the electrostatic liquid developer have an average by area particle size of less than 10 μm, preferably the average by area particle size is less than 5 μm. The resin particles of the developer having the metallic soap dispersed therein may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one of thermoplastic resin, metallic soap, and dispersant polar liquid described above. Generally the resin, metallic soap, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step in generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80 to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to ~13 mm).

After dispersing the ingredients in the vessel, with or without a polar additive present until the desired dispersion is achieved, typically 1 hour with the mixture being fluid, the dispersion is cooled, e.g., in the range of 0° C.

to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 10 percent by weight, preferably 0.3 to 3.0, and more preferably 0.5 to 2 weight percent with respect to the dispersant nonpolar liquid. One or more nonpolar liquid soluble ionic or zwitterionic charge director compounds (C), of the type set out above, can be added to impart a positive or negative charge, as desired. The addition may occur at any time during the process; preferably at the end of the process, e.g., after the particulate media, if used, are removed and the concentration of toner particles is accomplished. If a diluting dispersant nonpolar liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step. It has been found that when the adjuvant is a polyhydroxy compound it is added after process step B or C.

Other process embodiments for preparing the electrostatic liquid developer include:

(A) dispersing a metallic soap in a thermoplastic resin in the absence of a dispersant nonpolar liquid having a Kauri-butanol value of less than 30 to form a solid mass.

(B) shredding the solid mass, (C) grinding the shredded solid mass by means of particulate media in the presence of a liquid taken from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a liquid soluble ionic or zwitterionic charge director compound, and (A) dispersing a metallic soap in a thermoplastic resin in the absence of a dispersant nonpolar liquid having a Kauri-butanol value of less than 30 to form a solid mass.

(B) shredding the solid mass, (C) redispersing the shredded solid mass at an elevated temperature in a vessel in the presence of a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound.

A preferred mode of the invention is described in Example 9.

INDUSTRIAL APPLICABILITY

The electrostatic liquid developers of this invention demonstrate improved image quality, resolution, solid area coverage, and toning of fine details, evenness of toning, reduced squash independent of charge director and pigment present. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the electrostatic liquid developers include: digital color proofing, lithographic printing plates, and resists.

EXAMPLES

The following controls and examples wherein the parts and percentages are by weight illustrate but do not limit the invention. In the examples the melt indices were determined by ASTM D 1238, Procedure A, the average particle sizes by area were determined by a Horiba CAPA-500 centrifugal particle analyzer as described above, the conductivity was measured in picomhos (pmho)/cm at 5 hertz and low voltage, 5 volts, and the density was measured using a Macbeth densitometer model RD918. The resolution is expressed in the Examples in line pairs/mm (lp/mm).

CONTROL 1

In a Union Process 1-S Attritor, Union Process Company, Akron, Oh. was placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue G XBT-583D, manufactured by Heubach, Inc. Newark, NJ | 14.75 |
| Dalamar ® Yellow YT-858D pigment, manufactured by Heubach,Inc. | 0.3 |
| Isopar ® -L, nonpolar liquid having a Kauri-butanol value of 27, Exxon Corporation | 1000.0 |

The ingredients were heated to 90° C.±10° C. and milled at a rotor speed of 230 rpm with 0.1875 inch (4.76 mm) diameter stainless steel balls for two hours. The attritor was cooled to 42° C.±5° C. while the milling was continued and then 700 grams of Isopar ®-H, nonpolar liquid having a Kauri-butanol value of 27, Exxon Corporation were added. Milling was continued and the average particle size by area was monitored. The particulate media were removed and the dispersion of toner particles was then diluted to 1 percent solids by weight with additional Isopar ®-H and a charge director, lecithin, was added (46 mg lecithin/g of developer solids). Image quality was determined using a Savin 870 copier at standard mode: Charging corona set at 6.8 kv and transfer corona set at 8.0 kv using carrier sheets such as Plainwell offset enamel paper number 3 class 60 pound test and Savin 2200 office copier paper. Image quality was found to be poor, toning uneven, and there was no toning of fine details. Conductivity results are shown in Table 2 below.

CONTROL 2

The procedure of Control 1 was repeated with the following exceptions: 14 grams of Heucophthal Blue G XBT-583D were used instead of the combination of pigments in Control 1 and the milling at 90° C.±10° C. was for 1.5 hours. The dispersion of toner particles was diluted to 2 percent solids, and charged with 31 mg lecithin/g developer solids. Image quality was found to be poor, toning uneven, and there was no toning of fine details.

CONTROL 3

The procedure of Control 2 was repeated with the following exceptions: 22 grams of a magenta pigment, Mobay RV6803, Pigment Red 122, manufactured by Mobay Chemical Corp., Haledon, NJ, were used instead of the cyan pigment. Milling at 90° C.±10° C. was for 1 hour. Image quality was found to be poor, toning uneven, and there was poor toning of fine details. Results are shown in Table 2 below.

CONTROL 4

The procedure of Control 3 was repeated with the following exception: 69.0 grams Basic Barium Petronate ® oil-soluble petroleum sulfonate, Sonneborn Division of Witco Chemical Corp., New York, NY (95 mg/g of developer solids) were used instead of lecithin. Image quality was found to be poor, toning uneven, and there was poor toning of fine details. Results are shown in Table 2 below.

CONTROL 5

Sample 1B in Example 1 was repeated with the following exceptions: 35.0 grams of polystyrene No. Ave. MW. 20,000 (Polysciences Inc., Warrington, PA) were used instead of 35.0 grams of the resin used in Example 1, and no aluminum tristearate was present. Toner was charged with 35 mg of lecithin/gram of developer solids. Image quality was similar to Control 2. Results are shown in Table 2 below.

CONTROL 6

Sample 1B in Example 1 was repeated with the following exceptions: no pigment and no aluminum tristearate were present. Image quality was similar to Control 2. Results are shown in Table 2 below.

EXAMPLE 1

In a Union Process 01 Attritor, Union Process Company, Akron, Ohio was placed the following ingredients:

| | AMOUNT (g) | |
|---|---|---|
| INGREDIENT | SAMPLE IA | SAMPLE IB |
| Copolymer of ethylene (89%) and methacrylic acid (11%), melt index at 190° C. is 100, Acid No. is 66 | 35.0 | 35.0 |
| Aluminum tristearate, manufactured by Mathe Chemical Corp., Lodi, NJ | 1.87 | 0.75 |
| Heucophthal Blue G XBT-583D, Heubach, Inc., Newark, NJ | 2.45 | 2.45 |
| Isopar ® L, nonpolar liquid having a Kauri-butanol value of 27, Exxon Corporation | 125.0 | 125.0 |

The ingredients were heated to 90° C.±10° C. and milled at a rotor speed of 230 rpm with 0.1875 inch (4.76 mm) diameter stainless steel balls for two hours. The attritor was cooled to room temperature while the milling was continued and then 125 grams of Isopar ®-H, nonpolar liquid having a Kauri-butanol value of 27, Exxon Corporation was added. Milling was continued and the average particle size by area was monitored. The particulate media were removed and the dispersion of toner particles was then diluted to 2 percent solids by weight with additional Isopar ®-H and a charge director, lecithin, was added at an amount of 31 mg/g of developer solids. Image quality was determined using a Savin 870 copier at standard mode as described in Control 1 using carrier sheets such as Plainwell offset enamel paper number 3 class 60 pound test. Image quality was found to be good, toning even, and even toning of fine details was also obtained when 2 percent (Sample 1B) or 5 percent (Sample 1A) of aluminum tristearate was dispersed in the resin, pigment and Isopar ®-L. Conductivity results are shown in Table 2 below.

EXAMPLE 2

The procedure described in Control 1 was repeated with the following exceptions: 15.35 grams of a cyan pigment comprised of 15.2 grams of Heucophthal Blue G XBT-583D and 0.15 gram of Dalamar® Yellow YT-858D pigment manufactured by Heubach Inc., Newark, NJ, were used and the milling was for 1.5 hours. 4.4 grams of aluminum tristearate were placed in the attritor along with the resin, pigment and Isopar®-L. The toner was charged with 31 mg lecithin/g of developer solids Image quality was found to be good, toning even, and even toning of fine details was obtained. Results are shown in Table 2 below.

EXAMPLE 3

The procedure of Example Sample 1B was repeated with the following exceptions: 3.5 grams of a magenta pigment, Mobay RV6803, C.I. Pigment Red 122 manufactured by Mobay Chemical Corp., Haledon, NJ, were used instead of the cyan pigment, and 0.77 gram of aluminum tristearate was used. 63.35 grams of Basic Barium Petronate® described in Control 4 (96 mg/g of developer solids) were used Image quality was found to be good, toning even, and even toning of fine details was obtained. Results are shown in Table 2 below.

EXAMPLE 4

Example 3 was repeated with the following exceptions: 2.17 grams of Mobay magenta pigment RV6803 and 1.33 grams of Indo® Brilliant Scarlet toner. Pigment Red 123, C.I. No. 71145, were added in place of the pigment used in Example 3, the milling at 90° C.±10° C. was for 2.5 hours and 63.91 grams of Basic Petronate® described in Control 4 (96 mg/g developer solids) were added as the charge director instead of lecithin. Image quality was found to be good, toning even, and even toning of fine details was also obtained. Results are shown in Table 2 below.

EXAMPLE 5

Example 2 was repeated with the following exceptions: 22 grams of Mobay magenta pigment RV6803 were used in place of the cyan pigment, the milling at 90° C.±10° C. was for 2.0 hours and 70 grams of Basic Barium Petronate® described in Control 4 (96 mg/g of developer solids) were used as the charge director instead of lecithin. 4.44 grams of aluminum tristearate were used. Toning quality was found to be good, toning even, and even toning of fine details was also obtained. Results are shown in Table 2 below.

EXAMPLE 6

Example 5 was repeated with the following exception: 14.7 grams lecithin (37 mg/g of developer solids) were used as the charge director. Toning quality was found to be good toning even, and even toning of fine details was also obtained. Results are shown in Table 2 below.

EXAMPLE 7

The procedure for Sample 1B in Example 1 was repeated with the following exception: Additives disclosed in Table 1 were added in place of aluminum tristearate. Toning quality was found to be good toning even, and even toning of fine details was also obtained. Results are shown in following Table 1.

TABLE 1

| TONER SAMPLE | ADDITIVE | CONDUCTIVITY BULK | CONDUCTIVITY SOLN | CONDUCTIVITY PART | RESOLUTION | SOLID AREA | SQUASH | DENSITY |
|---|---|---|---|---|---|---|---|---|
| 7A | Al distearate (Mathe Chem. Co.) | 70 | 63 | 7 | 9–10 | good | low | 2.12 |
| 7B | Al octoate (Witco Chem. Corp.) | 70 | 57 | 13 | 11–12 | good | v low | 1.90 |
| 7C | Ba stearate (Witco Chem. Corp.) | 68 | 68 | 0 | 5–7 | poor | high | 1.69 |
| 7D | Zn stearate (Witco Chem. Corp.) | 68 | 65 | 3 | 9–10 | good | high | 2.23 |
| 7E (control) | Stearic acid (Aldrich Chem. Co.) | — | — | — | 4–6 | poor | v high | 1.47 |

EXAMPLE 8

The procedure described in Example 2 was repeated with the following exceptions: 14.3 grams of Heucophthal Blue G XBT-583D were used in place of the cyan pigment, 4.37 grams of aluminum octoate were used in place of the aluminum tristearate and milling at 90° C. ±10° C. was for 2.0 hours. Toning quality was found to be good, toning even, and even toning of fine details was also obtained. Results are shown in Table 2 below.

EXAMPLE 9

Example 2 was repeated with the following exception: 0.50 gram of triisopropanol amine (TIPA) were added after charging. Toning quality was found to be good, toning even, and even toning of fine details was also obtained. Results are shown in Table 2 below.

EXAMPLE 10

Example 6 was repeated with the following exception: 0.50 gram of TIPA was added after charging. Toning quality was found to be good, toning even, and even toning of fine details was also obtained. Results are shown in Table 2 below.

EXAMPLE 11

Example 9 was repeated with the following exceptions: 5.44 grams of aluminum tristearate were added instead of the 4.4 g used in Example 9. 2.76 grams of TIPA were added to the attritor along with the resin, aluminum tristearate, pigment and Isopar®-L instead of being added after charging Toning quality was found to be good, toning even, and even toning of fine details was also obtained. Results are shown in Table 2 below.

EXAMPLE 12

Sample 1B in Example 1 was repeated with the following exceptions: 2.40 grams of Heucophthal Blue G XBT-583D were used instead of 2.45 grams and 0.02 gram of aluminum tristearate (0.05% based on the total weight of the developer solids) were used instead of 0.75 gram. Image quality was improved compared to Control 2 with improved resolution, toning of fine details, and solid area coverage. Results are shown in Table 2 below.

EXAMPLE 13

Example 12 was repeated with the following exceptions: 3.27 grams of Heucophthal Blue G XBT-583D were used instead of 2.40 grams and 12.76 grams of aluminum tristearate were used instead of 0.02 gram. Image quality was improved compared to Control 2 with improved resolution, toning of fine details, squash, and evenness of toning. Solid area coverage was more even than Control 2 but also contained flow and beading. Results are shown in Table 2 below.

EXAMPLE 14

Example 2 was repeated with the following exceptions: 14.0 grams of Heucophthal Blue G XBT-583D were used instead of the combination of pigments, 4.37 grams of aluminum tristearate were used instead of 4.4 grams, and milling time was 2 hours. After charging 1.2 grams of OLOA®-1200 were added to the toner. Image quality was improved compared to Control 2 with improved resolution, toning of fine details, squash, solid area coverage, and evenness of toning. Results are shown in Table 2 below.

EXAMPLE 15

Example 14 was repeated with the following exception: after charging, 0.1 gram of triethanolamine was added to the toner. Image quality was improved compared to Control 2 with improved resolution, toning of fine details, squash, solid area coverage, and evenness of toning. Results are shown in Table 2 below.

Example 16

Example 14 was repeated with the following exception: after charging, 0.5 gram of 5-amino-1-pentanol was added to the toner. Image quality was improved compared to Control 2 with improved resolution, toning of fine details, squash, solid area coverage, and evenness of toning. Results are shown in Table 2 below.

Example 17

Control 5 was repeated with the following exceptions: 40.0 grams of polystyrene were used instead of 35.0 grams, and 0.75 gram of aluminum tristearate (Witco Chem. Corp. 132) was used. Image quality was improved compared to Control 5 with improved resolution, solid areas, toning of fine details, squash, and evenness of toning. Results are shown in Table 2 below.

Example 18

Control 6 was repeated with the following exception: 0.71 gram of aluminum tristearate (Mathe Chemical Corp.) was added. Image quality was improved compared to Control 6 with improved resolution, solid areas, toning of fine details, squash, and evenness of toning. Results are shown in Table 2 below.

Example 19

Example 13 was repeated with the following exceptions: 3.70 grams of Heucophthal Blue G XBT-583D were used instead of 3.27 grams and 19.06 grams (33% based on the total weight of the developer solids) of aluminum tristearate (Mathe Chemical Corp.) were used instead of 12.76 grams. Image quality was improved compared to Control 2 with improved resolution, toning of fine details, squash, and evenness of toning. Solid area coverage was more even than Control 2 but also contained flow and beading. Results are shown in Table 2 below.

Example 20

Example 1 Sample 1B was repeated with the following exceptions: 0.76 gram of aluminum tristearate (Mathe Chemical Corp.) was used instead of 0.75 gram. In addition toner was prepared using 250 grams of Aromatic 100 instead of 125 grams of Isopar*-L and 125 grams of Isopar*-H. Image quality was improved compared to Control 2 with improved resolution, toning of fine details, squash, solid area coverage, and evenness of toning. Results are shown in Table 2 below.

Example 21

Example 14 was repeated with the following exception: after charging, 2.31 grams of ethylene glycol were added to the toner. Image quality was improved compared to Control 2 with improved resolution and evenness of toning. Solid area coverage was more even than Control 2 but also contained flow and beading. Results are shown in Table 2 below.

TABLE 2

| TONER | CONDUCTIVITY | | | RESOLU- | SOLID | | DEN- |
|---|---|---|---|---|---|---|---|
| SAMPLE | BULK | SOLN | PART | TION | AREA | SQUASH | SITY |
| CONTROL 1 | 75 | 71 | 4 | 4–6 | poor | high | 1.46 |
| CONTROL 2 | 61 | 59 | 1 | 4–6 | v poor | high | 1.27 |
| CONTROL 3 | — | — | — | 4–5 | poor | v high | 2.65 |
| CONTROL 4 | — | — | — | 8–9 | poor | v high | 2.04 |
| CONTROL 5 | 70 | 70 | 0 | 3–4 | v poor | v high | 0.80 |
| CONTROL 6 | 80 | 76 | 4 | 2–3 | v poor | high | — |
| EX. 1A | 74 | 59 | 15 | 10–11 | good | v low | 1.53 |
| EX. 1B | 65 | 60 | 5 | 10–11 | good | low | 2,04 |
| EX. 2 | 68 | 58 | 10 | 10–12 | v good | v low | 1.64 |
| EX. 3 | 57 | 48 | 9 | 8–10 | good | low | 1.37 |
| EX. 4 | — | — | — | 9–10 | good | low | 1.29 |
| EX. 5 | — | — | — | 8–10 | good | low | 1.17 |
| EX. 6 | 55 | 46 | 9 | 10–11 | good | low | 1.7 |
| EX. 8 | 63 | 50 | 13 | 11–12 | good | v low | 1.54 |
| EX. 9 | 75 | 68 | 7 | 12–14 | excellent | none | 1.81 |
| EX. 10 | 67 | 55 | 12 | 12–14 | excellent | none | 1.17 |
| EX. 11 | 65 | 58 | 7 | 10–11 | good | low | 1.93 |

TABLE 2-continued

| TONER SAMPLE | CONDUCTIVITY BULK | SOLN | PART | RESOLUTION | SOLID AREA | SQUASH | DENSITY |
|---|---|---|---|---|---|---|---|
| EX. 12 | 63 | 63 | 0 | 8–9 | poor | high | 2.10 |
| EX. 13 | 78 | 53 | 25 | 10–12 | poor | none | 0.93 |
| EX. 14 | 75 | 60 | 15 | 9–10 | good | high | 1.34 |
| EX. 15 | 75 | 60 | 15 | 9–10 | excellent | high | 1.31 |
| EX. 16 | 44 | 34 | 10 | 10–11 | excellent | high | 1.86 |
| EX. 17 | 72 | 72 | 0 | 5–8 | poor | low | 1.11 |
| EX. 18 | 78 | 64 | 14 | 4–5 | excellent | v low | — |
| EX. 19 | 80 | 45 | 35 | 11–13 | poor | none | 0.81 |
| EX. 20 | 95 | 75 | 20 | 9–10 | good | low | 1.39 |
| EX. 21 | 50 | 50 | 0 | 6–7 | poor | v high | 0.96 |

I claim:

1. An electrostatic liquid developer having improved charging characteristics consisting essentially of (A) a nonpolar liquid having a Kauri-butanol value of less than 30, present in a major amount.

(B) thermoplastic resin particles having dispersed therein a metallic soap, the resin particles having an average by areas particle size of less than 10μm, and (C) a nonpolar liquid soluble ionic or zwitterionic charge director compound.

2. An electrostatic liquid developer according to claim 1 wherein the metallic soap is a polyvalent metal salt of a carboxylic acid of at least 6 carbon atoms.

3. An electrostatic liquid developer according to claim 2 wherein the polyvalent metal is selected from the group consisting of barium, calcium, magnesium, strontium, zinc, cadmium, aluminum, gallium, lead, chromium, manganese, iron, nickel, and cobalt.

4. An electrostatic liquid developer according to claim 1 wherein component (A) is present in 85 to 99.9% by weight, based on the total weight of liquid developer, the total weight of developer solids is 0.1 to 15.0% by weight, and component (C) is present in an amount of 1 to 1000 mg/g developer solids.

5. An electrostatic liquid developer according to claim 4 wherein the metallic soap is present in 0.01 to 60% by weight based on the total weight of the developer solids.

6. An electrostatic liquid developer according to claim 1 containing up to about 60 percent by weight of a colorant based on the total weight of developer solids.

7. An electrostatic liquid developer according to claim 6 wherein the colorant is a pigment.

8. An electrostatic liquid developer according to claim 6 wherein the colorant is a dye.

9. An electrostatic liquid developer according to claim 1 wherein a fine particle size oxide is present.

10. An electrostatic liquid developer according to claim 1 wherein an additional compound is present which is an adjuvant selected from the group consisting of polyhydroxy compound, aminoalcohol, polybutylene succinimide, and an aromatic hydrocarbon.

11. An electrostatic liquid developer according to claim 6 wherein an additional compound is present which is an adjuvant selected from the group consisting of polyhydroxy compound, aminoalcohol, polybutylene succinimide, and an aromatic hydrocarbon.

12. An electrostatic liquid developer according to claim 10 wherein a polyhydroxy adjuvant compound is present.

13. An electrostatic liquid developer according to claim 10 wherein an aminoalcohol adjuvant compound is present.

14. An electrostatic liquid developer according to claim 10 wherein a polybutylene succinimide adjuvant compound is present.

15. An electrostatic liquid developer according to claim 10 wherein an aromatic hydrocarbon adjuvant compound is present.

16. An electrostatic liquid developer according to claim 13 wherein the aminoalcohol adjuvant compound is triisopropanolamine.

17. An electrostatic liquid developer according to claim 1 wherein the thermoplastic resin is a copolymer of ethylene and an $\alpha,\beta$-ethylenically unsaturated acid selected from the group consisting of acrylic acid and methacrylic acid.

18. An electrostatic liquid developer according to claim 1 wherein the thermoplastic resin is polystyrene.

19. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

20. An electrostatic liquid developer according to claim 6 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

21. An electrostatic liquid developer according to claim 19 wherein the thermoplastic resin is a copolymer of ethylene (89%)/methacrylic acid (11%) having a melt index at 190° C. of 100.

22. An electrostatic liquid developer according to claim 1 wherein the particles have an average by area particle size of less than 5μm.

23. An electrostatic liquid toner according to claim 1 wherein component (C) is Basic Barium Petronate.

24. An electrostatic liquid toner according to claim 1 wherein component (C) is lecithin.

* * * * *